US006751866B2

(12) United States Patent
Yusufov et al.

(10) Patent No.: US 6,751,866 B2
(45) Date of Patent: Jun. 22, 2004

(54) CUTICLE CUTTING INSTRUMENT

(76) Inventors: Salman Yusufov, 1439 Duncan Ave., #5D, Brooklyn, NY (US) 11230; Nazim Yusufov, 2250 83rd St., #3A, Brooklyn, NY (US) 11214

( * ) Notice: Subject to any disclaimer, the term of this patent is extended or adjusted under 35 U.S.C. 154(b) by 0 days.

(21) Appl. No.: 10/175,171

(22) Filed: Jun. 18, 2002

(65) Prior Publication Data

US 2003/0229989 A1 Dec. 18, 2003

(51) Int. Cl.[7] ..... A45D 29/00; B26B 13/00

(52) U.S. Cl. ..... 30/28; 30/29; 30/131; 30/133; 30/186; 30/187; 30/244; 30/245; 132/75.5; 606/174

(58) Field of Search ..... 30/26.27, 28.29, 30/29.5, 41, 41.5, 41.6, 41.9, 43, 43.4, 43.5, 43.6, 49, 131, 132, 133, 194, 208, 240, 244, 263, 265, 346.51, 175, 186, 187, 188, 189, 190, 191, 192, 193, 245; 132/75.4, 75.5; 606/131, 138, 174; D24/147, 148, 149

(56) References Cited

U.S. PATENT DOCUMENTS

| | | | | | |
|---|---|---|---|---|---|
| 1,262,536 | A | * | 4/1918 | Martin | 30/240 X |
| 2,074,020 | A | * | 3/1937 | Marholt | 30/29.5 |
| 2,111,861 | A | * | 3/1938 | Knapp | 30/29.5 |
| 2,262,315 | A | * | 11/1941 | Davies | 30/29.5 |
| 2,894,324 | A | * | 7/1959 | Hardin | 30/240 |
| 3,151,392 | A | * | 10/1964 | Chambers | 30/240 |
| 3,699,652 | A | * | 10/1972 | Deverman et al. | 30/29.5 |
| 4,051,596 | A | * | 10/1977 | Hofmann | 30/133 |
| 4,868,984 | A | * | 9/1989 | Elsherbini | 30/133 |
| 5,255,437 | A | * | 10/1993 | Chen | 30/29.5 |
| 6,428,539 | B1 | * | 8/2002 | Baxter et al. | 606/174 X |

* cited by examiner

*Primary Examiner*—Clark F. Dexter
(74) *Attorney, Agent, or Firm*—I. Zborovsky

(57) ABSTRACT

A cuticle cutting instrument has tubes rotatably disposed in each other and forming two working endings, cutting elements provided on the endings, handles fixed on the tubes, a return spring installed between the handles, and a tubing connection for communicating with a vacuum source.

15 Claims, 3 Drawing Sheets

CUTICLE CUTTING INSTRUMENT

BACKGROUND OF THE INVENTION

The present invention relates to a cuticle cutting instrument such as a cuticle nipper or cuticle scissor.

Such instruments are known in the art and described, for example, in U.S. Pat. No. 2,894,324. Cutting elements of the known instrument are provided on the front of a tube and a rod which is rotatably disposed in the tube. One of two handles hingedly connected with each other, is fixed with the tube, while the other is hingedly connected with an additional cylinder having spiral slots engaged with pins of the rod.

Another instrument is described in U.S. Pat. No. 2,074,020. The instrument has two tubes with cutting elements on their front ends rotatably arranged within each other. A driving mechanism is provided which makes it possible to effect the rotation of the tubes by pressing upon one or two lateral lever arms with the fingers of the hand holding machine.

However, their construction does not provide for installation of the cutting elements on their rear end.

SUMMARY OF THE INVENTION

Accordingly, it is one object of the present invention to provide a cuticle cutting instrument which avoids the disadvantages of the prior art.

In keeping with this object and with others which will become apparent hereinafter, one feature of the present invention resides, briefly stated, in a cuticle cutting instrument which has tubes rotatably disposed in each other and having the front and the rear working ends intended for installing cutting elements, a driving mechanism, and a tubing connection for communication with a vacuum source.

Accordingly with another feature of the invention the cutting elements may be replaceable.

The novel feature of the present invention will be defined in the claims.

The invention itself, however, will be best understood from the following description which are accompanied by the drawings.

DESCRIPTION OF PREFERRED EMBODIMENTS

Figures 1, 2, 3, 4, 5, 6, 7:
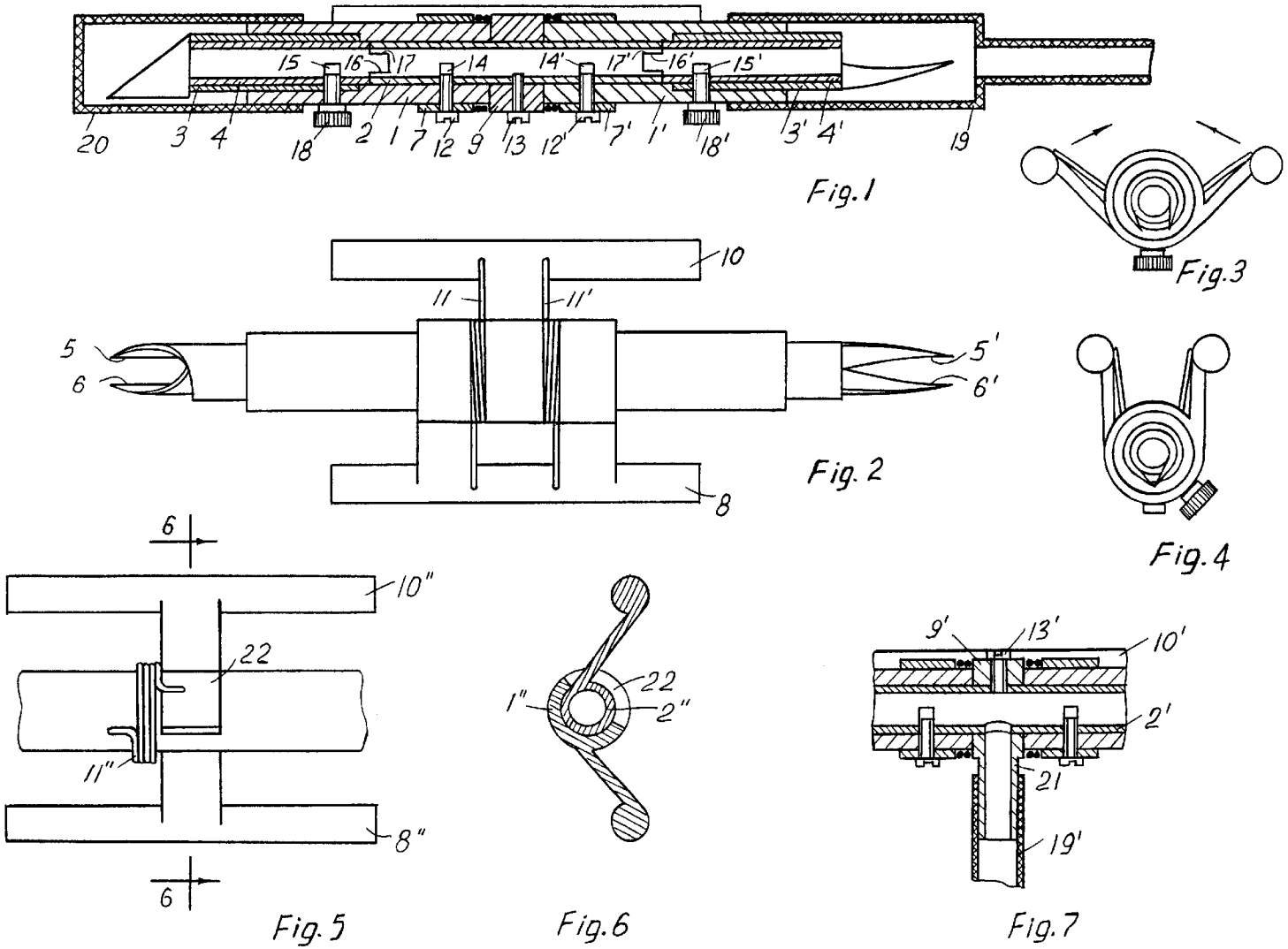
FIG. 1 is a longitudinal sectional view of the cuticle cutting instrument in accordance with the present invention.
FIG. 2 is a vertical view of FIG. 1.
FIG. 3 is a front view illustrating the cutting elements in open relation.
FIG. 4 is a front view illustrating the cutting elements in closed or cutting relation.
FIG. 5 is a fragmentary view of the instrument with different connection of handles.
FIG. 6 is a cross-sectional view of FIG. 5
FIG. 7 is a fragmentary sectional view showing an alternative connection with the vacuum source.
Figure 8:
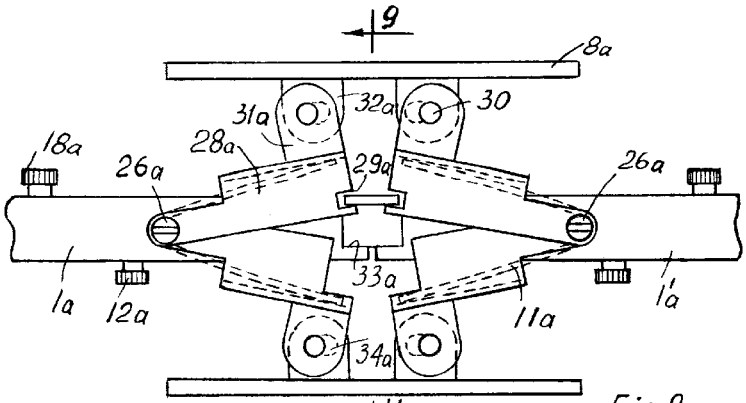
FIGS. 8,16,20 are vertical views of the instrument with alternative driving mechanisms in the open relation.
Figure 9:
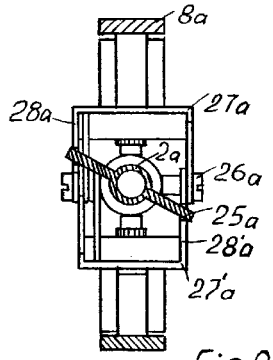
FIGS. 9,17,21 are sectional views on the line 9—9,17—17,21—21 of FIGS. 8,16,20 accordingly.
Figure 10:
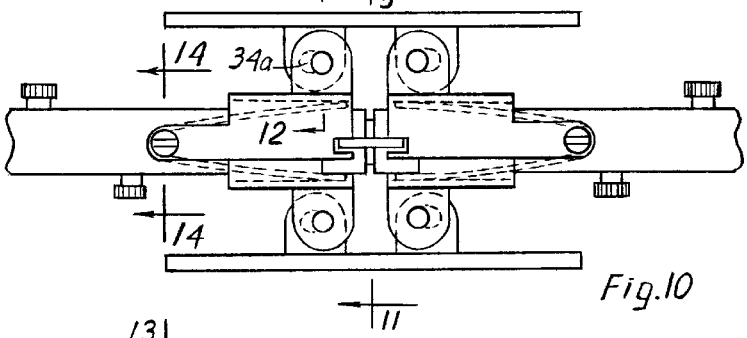
FIGS. 10,18 are vertical views of FIGS. 8,16 in closed position.
Figure 11:
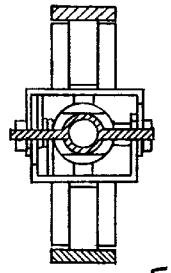
FIGS. 11,19 are sectional views on the line 11—11,19—19 of FIGS. 10,18 accordingly.
Figure 12:
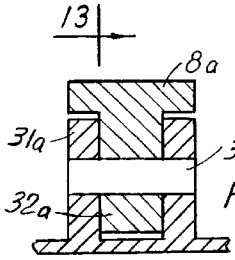
FIG. 12 is a section along line 12—12 in FIG. 10.
Figure 13:
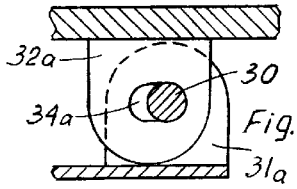
FIG. 13 is a section along line 13—13 in FIG. 12.
Figure 14:
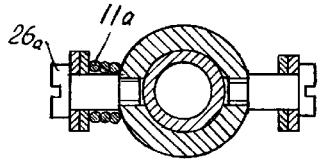
FIG. 14 is a section 14—14 of FIG. 10.
Figure 15:
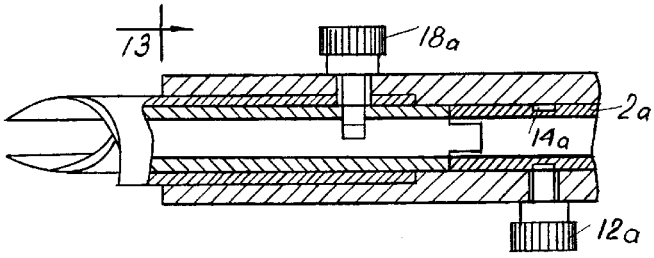
FIG. 15 is a cross section showing an inserted cutting element
Figure 22:
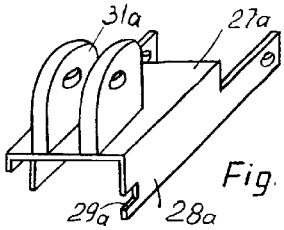
FIGS. 22,23 are perspective views of the lateral lever arms.
Figure 23:
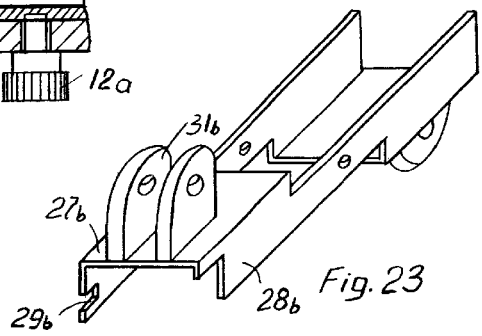
Figure 16:
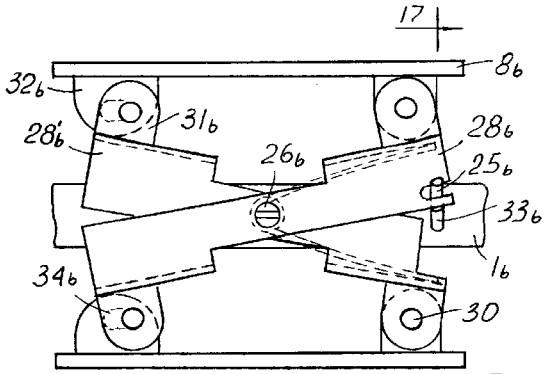
Figure 17:
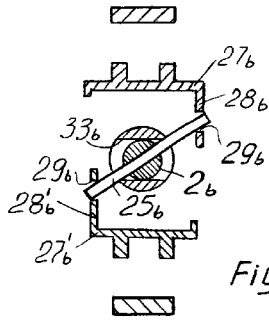
Figure 18:
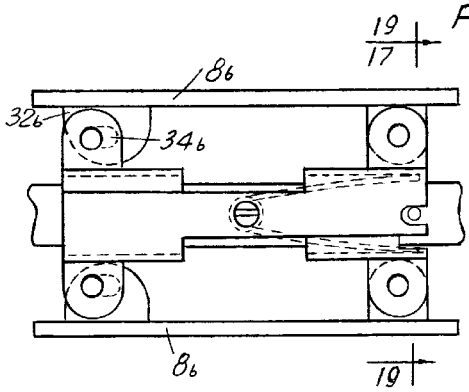
Figure 19:
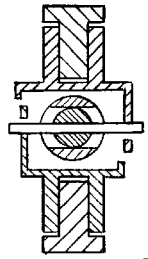
Figure 20:
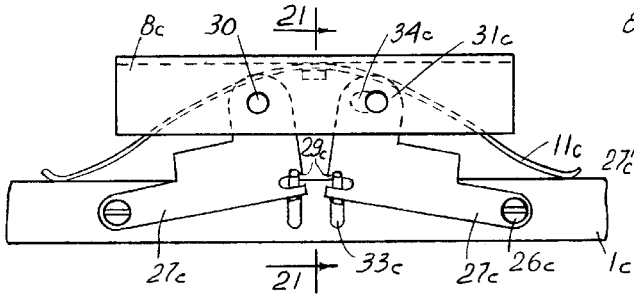
Figure 21:
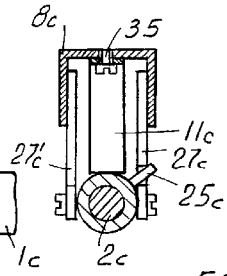
Figure 24:
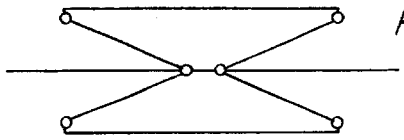
FIGS. 24 to 28 are mechanical diagrams with alternative driving mechanisms.
Figure 25:
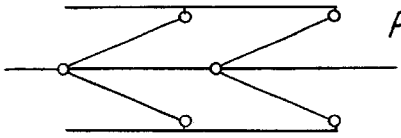
Figure 26:
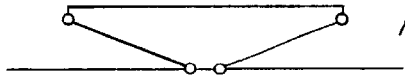
Figure 27:
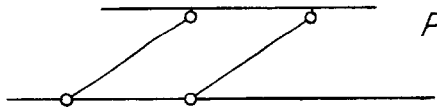
Figure 28:
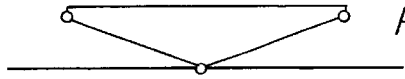

A cuticle cutting instrument in accordance with the present invention has an outer member consisting of tubes 1, 1' (FIGS. 1, 2), an inner member (a tube) 2 rotatably disposed in the tubes 1,1', cutting elements 3, 4 of a cuticle nipper which have cutting edges 5,6, and cutting elements 3',4' of a cuticle scissor which have cutting edges 5',6' provided on two working ends of the instrument, a driving mechanism consisting of a handle 8, handle 10 and two (or one) return springs 11,11' installed between the handles 8,10. The handle 10 has a rim 9 fixed on the tube 2 by screw 13, and the handle 8 has rims 7,7' fixed on the tubes 1,1' by screws 12,12' protruding through transversal slots 14,14' in the tube 2, which prevent axial shifts of the cylinders 1,1' along the tube 2.

When a user presses handles 8,10, cylinders 1,1' and 2 turn in the opposite directions shown by arrows (FIG. 3), and the edges 5,6 and 5',6' of the cutting elements 3,4 and 3',4' accordingly come together (FIG. 4). After that, springs 11, 11' return the instrument in the initial position.

Cutting elements 3,4 and 3',4' may be replaceably connected with tubes 1, 1' by screws 18,18', which protrude through transversal slots 15, 15' of the cutting elements 4, 4'. The cutting elements are engaged with the instrument by projections 16,16' on the cylinders 4,4' and slots 17,17' on the member 2. Screws 18,18' prevent an axial shifts of the cutting elements 4,4' accordingly.

The non-useable end of the instrument may be closed with a safety cap 20, or connected with a vacuum source by a hose 19.

A handle 8" (FIGS. 5,6) may be fixed with the outer tube 1" while a handle 10", protruding through a transversal slot 22 in a cylinder 1", is fixed with an inner member 2". A spring 11" is engaged with the cylinder 1" and with the inner member 2" by its bended endings, one of which protrudes through the transversal slot 22 in the cylinder 1".

The instrument may be connected with a hose 19' of a vacuum source (FIG. 7) by a tubing connection 21 communicating with a hole in the inner member 2' in the middle portion of the instrument, and fixed with a rim 9' of a handle 10'.

The instrument (FIGS. 8 to 23) may have an outer member (or members) remaining in unvarying position in relation to the handles while cutting is effected by rotation of the inner member in order to avoid any undesired movement and therefore also avoiding any danger of bringing the cutting edge in touch with, for example, the cuticle (skin) and cutting the same.

The outer member of the instrument may consist of tubes 1*a*, 1'*a* (FIGS. 8,9), and an inner member (tube or rod) 2*a* is rotatably disposed in the tubes 1*a*,1'*a*. The inner cylinder 2*a* is provided with a two rectangle pins 25*a* arranged at opposite ends of a diameter. On the outer cylinder 1*a*, 1'*a* four studs 26*a* are screwed in, on which two pair of lateral lever arms 27*a* and 27'*a*, are rotatably mounted. These lever arms have (FIG. 22) U-shaped cross-section and embrace the cylinders. Each lever arm has a pair of loops 31*a* while handles 8*a* have loops 32*a* with slots 34*a*. Pins 30 fixed in the loops 31*a* protrude into the slots 34*a* of the loops 32*a*. Flanges 28*a*, 28'*a* of the lever arms lying in the planes of movement, are provided with slots 29*a* in which one of the pin 25*a* engages whereby a gear connection is provided which effects a rotation of the cylinders 1*a*, 1'*a* and cylinder 2*a* against each other, if the handles 8*a* are compressed. The pins 25*a* protrude through two opposite slots 33*a* on adjusting ends of the cylinders 1*a*,1'*a* which limit its angle of turn, and therefore, the positions of the lever arms. The two pairs of lever arms are biased apart by two return springs 11*a*. Initially, the pins 30 are in an outer position in the slots 34*a*. If the handles are compressed (FIGS. 10,11), pins 30 are moved to an inner position in the slots 34*a*. Screws 12*a* (FIG. 15) are screwed into the outer tubes 1*a*, 1'*a* and engage with their points the grooves 14*a* arranged on part or on the entire circumference of the inner member 2*a* to prevent axial shifts of the cylinders. Screws 18*a* fix the replaceable cutting elements.

The ends of inner member 2*b* (FIGS. 16,17) may have at its one (or two) lower portion a round pin 25*b* arranged at the opposite ends of the diameter for connection with slots 29*b* of flanges 28*b*, 28'*b* of lever arms 27*b*,27'*b* whereby gear connection is provided. An outer tube 1*b* may have two slots 33*b* arranged at the opposite sides of the diameter. The side views of the lever arms (FIG. 23) are Z-shaped, and the cross-section of its opposite ends are U-shaped. Each lever arm has a window, and the lever arm 27'*b* is inserted into the window of the lever arm 27*b*. After that the cylinders 1*b*, 2*b* are inserted into the lever arms. Two studs 26*b* are screwed in, on which the two lever arms are rotatably mounted. If the handles 8*b* are compressed (FIGS. 18,19), the lever arms with U-shaped cross-section embrace the right and the left portions of the cylinders. Only one loop 32*b* of each handle 8*b* may have the slot 34*b*. The pin 25*b* of the inner member 2*b* protrudes through slots 33*b* and prevent axial shifts of the cylinders 1*b* and 2*b*.

The cuticle cutting instrument may have four plates 27*c*,27'*c* (FIGS. 20,21) representing lever arms and connected with a U-shaped handle 8*c* by pins 30 and slots 34*c* provided in the right pair of the plates 27*c* and 27'*c*. The plates 27*c* are engaged with pins 25*c* by slots 29*c*. Slots 33*c* of cylinder 1*c* and the pins 25*c* prevent axial shifts of the cylinders 1*c* and 2*c*. The slots 29*c* in the one side pair of the plates 27*c* are engaged with the pins 25*c* of inner member 2*c* protruding through the slots 33*c*. The plates are mounted on the cylinder 1*c* by studs 26*c*. A flat spring 11*c* installed between the handle 8*c* and the cylinder 1*c*, is fixed with the handle by a screw 35.

FIGS. 24 to 28 show the mechanical diagrams of the cuticle cutting instrument with the different positions of the lever arms of the driving mechanism.

Cutting elements may be integral with tubes.

The nipper (or scissor) may be provided only on a front end of the instrument.

The invention is not limited to details shown since structural changes are possible without departing from the spirit of the same.

What is claimed is:

1. A cuticle cutting instrument, comprising an outer tubular member; an inner tubular member disposed in said outer tubular member so that said tubular members are rotatable relative to one another, said outer and inner tubular members each having an axis and two axial ends; and only one pair of cutting elements provided at each of said axial ends and arranged so that one cutting element of each of said pairs is arranged on said outer tubular member and the other cutting element of each of said pairs is arranged on said inner tubular member, each of said pairs of cutting elements forming one of a nipper and a scissor, so that when said tubular members are rotated relative to one another said cutting elements of each of said pairs can cut cuticles; driving means for rotating said tubular members relative to one another, and means for connecting each of said axial ends of said tubular members with each of said pairs of said cutting elements so that each said pair of said cutting elements is removable from a respective one of said ends of said tubular members, thereby allowing to provide one pair of said cutting elements on one of said axial ends, one pair of said cutting elements on the other of said axial ends, or two pairs of said cutting elements on both said axial ends.

2. A cuticle instrument as defined 1; and further comprising a safety cap removeably attached to a respective one of said ends of said tubular members so as to cover a respective one of said pairs of said cutting elements, said safety cap being attachable to and detachable from either of said axial ends of said tubular members.

3. A cuticle cutting instrument as defined 2; and further comprising a hose removeably attached to said tubular members for connection with a source of suction, said hose being attachable to and detechable from either of said axial ends of said tubular members.

4. A cuticle cutting instrument as defined 3, wherein said safety cap is removably, attached to one of said ends of said tubular members while said hose is attached to the other of said ends of said tubular members.

5. A cuticle cutting instrument as defined in 1; and further comprising a hose removably attached to said tubular members for connecting an interior of said tubular members with a source of suction, said hose being attached substantially to a middle portion of said tubular members between said axial ends so that both pairs of said cutting elements can be arranged at said ends, while said hose provides suction from the middle portion of said tubular members.

6. A cuticle cutting instrument as defined in claim 5, wherein said removable attachment of said tubular members to said hose is provided by a tubing connection that is attached to said tubular members and to said hose.

7. A cuticle cuffing instrument as defined in 1, wherein said driving means includes at least one pin formation connected with said inner tubular member, a lever mechanism including a plurality of levers connected with said outer tubular member, and handle means connected to and acting on said lever mechanism so that said levers are displaced from an initial position and turn said pin formation so as to turn said tubular members relative to one another.

8. A cuticle cutting instrument as defined 7, wherein said lever mechanism includes two pairs of levers each hingedly connected with the outer tubular member, wherein the two levers of each of said pairs are also movably connected with one another, so that when said handle means is actuated one pair of said levers moves toward the other pair of said levers so as to act on said pin formation and therefore to turn said tubular members relative to one another.

9. A cuticle cutting instrument as defined 8, wherein each of said levers is U-shaped.

10. A cuticle cutting instrument as defined in 7; and further comprising means for connecting each of said levers with said handle means, said connecting means including an elongated opening in one of said lever and said handle means and a pin connected to the other of said handle means and said lever and extending in said elongated opening.

11. A cuticle cutting instrument as defined 7, wherein said lever mechanism includes two levers which extend across one another and are connected hingedly with one another at a point of intersection of said levers, said levers having opposite ends connected to said handle means so that when said handle means act on said opposite ends of said levers, said levers turn relative to one another and act on said pin formation.

12. A cuticle cutting instrument as defined in 11, and further comprising connecting means for connecting at least one end of each of said levers to said handle means, said connecting means including a pin connected to one of said handle means and said lever, and an elongated hole in which said pin extends, said hole disposed in the other of said handle means and said lever.

13. A cuticle cutting instrument as defined 7, wherein said lever mechanism includes four levers arranged so that two levers are located at one radial side of said tubular members and two levers are located at another radial side of said tubular members, each two levers located at each radial side being movably connected with one another, each of said levers having one end hingedly connected with said outer tubular member and another end connected with said handle means; and at least one spring arranged between said outer tubular member and said handle means so that said at least one spring biases said levers to said initial position.

14. A cuticle cutting instrument as defined 13, wherein said levers include U-shaped levers.

15. A cuticle cutting instrument as defined 13, wherein said handle means includes plate shaped handles.

* * * * *